US006168057B1

(12) United States Patent
Schwabe

(10) Patent No.: US 6,168,057 B1
(45) **Date of Patent: *Jan. 2, 2001**

(54) USER ATTACHABLE DEVICE FOR SECURING SINGLE USE CAMERAS AND THE LIKE ON CLOTHING

(76) Inventor: Barry E. Schwabe, 6309 Excelsior Blvd., #9, St. Louis Park, MN (US) 55416

( * ) Notice: Under 35 U.S.C. 154(b), the term of this patent shall be extended for 0 days.

This patent is subject to a terminal disclaimer.

(21) Appl. No.: 09/361,089

(22) Filed: Jul. 26, 1999

Related U.S. Application Data

(60) Division of application No. 08/908,686, filed on Aug. 7, 1997, now Pat. No. 5,927,579, which is a continuation-in-part of application No. 08/676,542, filed on Jul. 9, 1996, now abandoned.

(60) Provisional application No. 60/001,490, filed on Jul. 17, 1995.

(51) Int. Cl.[7] ..... A45F 5/00

(52) U.S. Cl. ..... 224/269; 224/901.8

(58) Field of Search ..... 224/901.8, 901.2, 224/901, 271, 269; 294/139; 396/424, 420; 352/243

(56) References Cited

U.S. PATENT DOCUMENTS

| | | | | |
|---|---|---|---|---|
| 4,236,658 | | 12/1980 | Kallman | 224/250 |
| 4,403,366 | | 9/1983 | Lucke | 224/901.8 |
| 4,690,316 | | 9/1987 | Peterson | 224/901.8 |
| 4,814,806 | | 3/1989 | Flax | 354/295 |
| 4,850,502 | | 7/1989 | Davis | 224/901.8 |
| 4,907,729 | * | 3/1990 | Hess, III | 224/253 |
| 4,953,770 | | 9/1990 | Bond, Sr. | 224/901.8 |
| 4,989,267 | | 2/1991 | Watson | 2/102 |
| 5,014,892 | | 5/1991 | Copeland | 224/271 |
| 5,050,830 | | 9/1991 | Hall | 224/901.8 |
| 5,143,371 | | 9/1992 | Strahan | 224/901.8 |
| 5,205,448 | | 4/1993 | Kester et al. | 224/151 |
| 5,221,031 | | 6/1993 | Prigmore | 224/901.8 |
| 5,251,800 | | 10/1993 | Leenders | 224/253 |
| 5,331,721 | | 7/1994 | Raum, Sr. | 224/269 |
| 5,522,638 | | 6/1996 | Falcoff et al. | 296/37.8 |
| 5,533,656 | | 7/1996 | Bonaldi | 224/901.8 |
| 5,711,424 | | 1/1998 | Kiesow | 206/316.2 |
| 5,927,579 | * | 7/1999 | Schwabe | 224/269 |

* cited by examiner

*Primary Examiner*—Renee Luebke
(74) *Attorney, Agent, or Firm*—Alan Kamrath

(57) ABSTRACT

A ready to use, self contained article holding device for use on clothing to hold and support articles of a suitable kind like single use cameras. This device has on one end a protective liner (51) that is peeled off to expose an adhesive (50) that is on the back of a fastening strip (48) for attachment to an article. A fastening material (52) on the reverse side of fastening strip (48) is joined to a complementary fastening material (38) on a fastening strip (46) that is connected by an adhesive back on the second fastener strip (46) to the larger front side of a securing mechanism base (42). Securing mechanism base (42) is made from a sturdy, nonharmful material so that is can support the weight of an attached item and not damage clothing from which it is held. Fastening strips (48 & 46) are made of material that will allow repeated releasing and replacing of attached products without reduction in holding ability. Clothing can be any suitable type, for example, a belt, a pant or skirt waistband, a pant pocket, etc.

19 Claims, 2 Drawing Sheets

USER ATTACHABLE DEVICE FOR SECURING SINGLE USE CAMERAS AND THE LIKE ON CLOTHING

CROSS REFERENCE

This application is a division of application Ser. No. 08/908,686, filed on Aug. 7, 1997, now U.S. Pat. No. 5,927,579, which is a continuation-in-part of application Ser. No. 08/676,542, filed on Jul. 9, 1996, now abandoned, which is based on provisional application serial No. 60/001,490 filed Jul. 17, 1995, all of which are incorporated herein by reference.

BACKGROUND

This invention relates to ready to use/self contained devices for holding single use cameras or articles of a suitable kind on clothing such as belts, pants or skirt waistbands, pants pockets, etc. where the article is a separate entity from the invention.

Prior art devices for holding small articles on clothing suffer from the disadvantage that they cannot be immediately used on single use cameras or articles of a suitable kind that are a separate entity from the invention because they require the article to have some sort of built on modification that would allow it to work with the device or require an adhesive separate from the invention for attaching a fastener onto an article before attachment to the device. In addition, the fastening mechanisms for many of these inventions do not hold well in physically demanding situations.

Single use cameras have not been used with carrying devices from the prior art. All of the prior art devices either cannot carry a single use camera effectively in the actual conditions where cameras are used or would involve mechanisms that are inconvenient and/or unattractive for single use camera users to use.

Photographic film manufacturers project selling over 50 million single use cameras in 1995. Single use cameras are used by consumers to provide an economical alternative for occasions where other cameras are not preferred or available.

Originally, single use cameras did not have carrying features which made convenience difficult. Consumers developed their own ways to transport and hold single use cameras. One method was carrying single use cameras in pockets of clothing, especially in pants pockets for men. However, this method has at least five disadvantages:

(a) If one places a single use camera in a pocket, there is often a bulge which is unsightly and uncomfortable, especially when one is seated.

(b) It takes pocket space away from other items consumers want in their pockets.

(c) Dirt from other items in the pocket can get on the lens, especially from items like facial tissue.

(d) It adds weight to pants pockets causing greater wear on clothing, especially sagging and potential for holes in pockets.

(e) The single use cameras are not always readily accessible for quick unexpected photo opportunities because of the difficulty in removing them from pockets, especially if pockets are small and contain other items.

A second method is carrying single use cameras in ancillary carrying products such as a daypack, fannypack, or handbag. In addition to the space, dirt, weight, and quick access drawbacks listed for the pocket method, this method has the following two disadvantages:

(a) The cameras are not always available for photo opportunities, especially if the person isn't near the bag.

(b) The cameras can be hard to find in bags that are filled completely with other larger items.

A third method is carrying the single use cameras in one's hand. Yet, this has the major liability of limiting one's hand movements.

Manufacturers are making two modifications that partially address the transport of single use cameras; however, these still have significant problems. The first modification is a reduction in size. Although this will make carrying single use cameras easier in pockets, the disadvantages of pocket transport will perhaps remain the same, only to a lesser degree.

The second modification is a wrist strap that is attached to an eye or lug on a corner of the single use camera. Although wrist straps are well recognized and inexpensive carrying devices, they are clumsy and a nuisance because they restrict hand mobility, strain the wrist, and dangle if left unheld. Furthermore, wrist straps can easily slip off a wrist if not cinched tightly or if the camera is not held, resulting in loss of the camera and its irreplaceable photos.

Currently, no products are sold separately to hold single use cameras on one's clothing except the current invention. The current invention has also been the point of difference of a new product for runners, namely a combination of the current invention and a single use camera which is bundled and positioned for marathoners. Although a small number of runners actually take cameras with them on marathons, the general population and the majority of runners do not associate taking photos during a 26.2 mile run. The ready to use capability of the current invention, in conjunction with its durability and nonintrusiveness, is changing this behavior.

Inventors have created several ways to hold articles to objects. U.S. Pat. No. 4,236,658 discloses a strap type system that holds articles to an object, but this system can be tedious to use with small articles. U.S. Pat. Nos. 5,014,892 and 5,251,800 disclose a camera belt clip with support plates and slots and a camera holder, respectively, but these inventions can be too complex and expensive for small or low value articles. U.S. Pat. No. 5,205,448 discloses a multifunction camera bag with waist belt support which is too cumbersome for carrying a small article. U.S. Pat. No. 4,814,806 discloses a camera lens cap holder which has a panel member connecting the camera and camera strap with a fabric fastener attached to the panel and a second fabric fastener attached to the lens cap; however, it can be annoying to carry an additional item on a camera strap. No patent notice exists on a universal belt clip marketed by Radio Shack which fixes an article permanently onto a belt clip.

Inventors have also developed ways to hold articles using fabric fasteners in unrelated fields; unfortunately, these inventions would not hold a single use camera or an article of a suitable kind on clothing adequately. U.S. Pat. No. 5,221,031 discloses a body mounted cutting apparatus comprised of a band able to encircle a body limb and a cutting tool. The '031 device is not made to be attached to clothing. This invention requires a fabric hook and loop fastener to be already adhesively fixed or applied separately onto the cutter's sheath which does not make this invention ready to use for other sheaths or cutting tools that don't come with the invention, thereby severely limiting its application. Articles that don't have an existing fastener won't work with this invention because they would need a fastener and some sort of part to adhere the fastener to the sheath.

In addition, the elongated fabric band limits the invention's applicability because wearing an arm band as part of a person's normal dress is not socially appropriate or comfortable at many of the kinds of occasions where single use cameras or articles of a suitable kind are commonly used, such as business events, weddings, etc. Wearing a single use camera or an article of a suitable kind like this could also create muscle problems like carpel tunnel disease because it may not be ergonomically correct to carry items bigger and heavier than a cutter. Other disadvantages include the requirement for a housing to hold the article to the band, the requirement to slide the article from the housing for use, and the requirement that access be made from the user's opposing hand versus from the hand on the same side that the article is worn which is preferable, but impossible with this invention. Another disadvantage is that the fastening material which is specifically cited, namely fabric hook and loop, does not function satisfactorily in situations where single use cameras or articles of a suitable kind are taken into more physically demanding conditions such as where the article is continuously rubbed against as in riding a bicycle or is under water as in snorkeling.

U.S. Pat. No. 4,403,366 is a removable towel which may be quickly and easily attached to and removed from the user's person. U.S. Pat. No. 4,690,316 is a method and apparatus for providing quick release retention for work pieces such as a tape measure. U.S. Pat. No. 4,953,770 is a holder for conventional billiard or pool cue chalk including a clip that is selectively attachable and complementary first and second hook and loop fastening elements.

All of these inventions cannot hold a single use camera or an article of similar size and weight satisfactorily because either the camera or article would fall off or, for U.S. Pat. Nos. 4,403,366 and 4,690,316, the securing mechanism base and the fastener thereon are not long enough to hold a single use camera or an article of similar size and weight, especially during strenuous activities. In addition, the base in U.S. Pat. No. 4,403,366 has a slight inward slope on its fastener side that would lessen the grip between a firm article like a camera and the clip versus a flexible article like a towel. U.S. Pat. No. 4,953,770 has a downward/inner slope on its fastener side that cannot hold an article like a single use camera effectively because the fasteners would not be tightly aligned, and the hook and loop fastener on its base is not long enough to hold an article like a single use camera. The base in U.S. Pat. No. 4,690,316 has a guard structure that makes it more difficult to reattach a camera during physical activity because it needs to be exactly fitted into position which can distract the user's concentration from the physical activity and be an inconvenience. U.S. Pat. No. 4,403,366 also requires a preexisting fastener on the towel and specifies a fastening material made from fabric hook and loop which limits the invention's applications to only the range of situations where the fabric hook and loop would hold. U.S. Pat. No. 4,953,770 specifies VELCRO® hook and loop fasteners which limits its applications to the range of situations where VELCRO® hook and loop fasteners would hold, too. U.S. Pat. No. 4,690,316 requires a preexisting fastener on the workpiece and doesn't specify how the fastener is attached to it which suggests that a separate adhesive is needed. U.S. Pat. No. 4,953,770 requires a preexisting fastener to come with the pool cue chalk that is on an elastic band that surrounds and stays on the pool cue chalk by both ends attaching to each other.

None of the fasteners in these inventions make the invention ready to use for articles that do not come with the invention because the fasteners are preattached on the towel, on the workpiece, and on the specially designed elastic band for a pool cue chalk, respectively, which severely limits the invention's applications to other articles.

U.S. Pat. No. 5,143,371 is a golfer's aid having a body in the shape of a clip which can be attached to clothing, a golf bag, or other article. Hook and loop fabric is attached in a nonspecified way to the outer surface of the body for attaching the user's glove or ball markers that have prefixed fasteners on them. Besides having the disadvantages of requiring that attached articles have prefixed fasteners on them, the specificity that it be hook and loop fabric limits its use in physically demanding situations other than what it was designed for, namely golfing. U.S. Pat. No. 5,050,830 relates to scorecard holders, specifically to such holders as used in the game of golf. This invention is intended for hanging on a golf bag and not worn on clothing. In addition, fastening material for articles such as pencils and golf tees are custom made for such items where those items slide in and out of their holder which would not work well with a single use camera or an article of suitable kind. A disadvantage of both inventions is that the securing mechanism base has an inward turn toward the wearer on its nonfastener side that could scratch against users wearing thin, lightweight clothing like, for example, running clothes.

U.S. Pat. No. 5,533,656 relates to a wallet device which can be removably mounted to clothing, and particularly, to wallet devices which have a removable clip. The '656 device has fasteners that are not on a securing mechanism base holding an article but are instead used to open and close a compartment on the invention.

No securing mechanism base with fasteners for holding an article exists in the '656 invention, which is not designed and cannot hold a single use camera or an article of suitable kind except for an awkward placement in the compartment of the invention.

U.S. Pat. No. 4,850,502 is a system that relates to a plurality of handles attached to opposed side of a container, for the convenient lifting and transportation of the container. The securing mechanism base of this invention is not wearable and, therefore, makes it impossible to carry a single use camera or an article of suitable kind on one's clothing.

Manufacturers and the prior art have not found a method for carrying single use cameras or articles of suitable kind that relieves the disadvantages cited. First, none of the inventors in the prior art for devices holding articles on clothing, who are skilled in the art, anticipated or suggested using fasteners with adhesive on their backs that can be used immediately upon removal of a protective liner even though these kind of fasteners have been available for approximately twenty years. Neither did these inventors realize the advantages of immediate use, broader applicability, and greater convenience that would result by incorporating the adhesive, liner, and fastener as one part on a complementary fastener attached to a securing mechanism base. In addition, none of the same inventors anticipated or suggested using industrial fasteners like DUAL LOCK® fasteners which increase the strength of holding devices and, thereby, increase the range of situations in which it can be used.

Most of the inventors specifically cite a cloth material for their fasteners. In addition, the use of DUAL LOCK® fasteners in water appears to be an unintended application for the fastening material since no prior mention of underwater properties has been discovered.

Second, none of the prior art inventions are broad enough in their physical characteristics that they could be used in applications where the current invention has been applied.

For example, they cannot work underwater or in physical situations where the article is rubbed against because the article would fall off with regular VELCRO® fasteners. In addition, they would not be preferred in situations such as marathons because they are not ready to use.

Third, none of the prior art inventions mention using different kinds of adhesives for articles with different kinds of surfaces which significantly effects results. Unfortunately, the mention of only an "adhesive" does not make the prior art inventions operable in many circumstances. For example, the underwater carrying device uses fasteners with different adhesive backings for the securing mechanism base and the underwater camera because of the different composition of their surfaces and how those surfaces relate to adhesives underwater.

A better solution is needed because it would allow more people to take advantage of single use cameras and other articles of suitable kind since they would be more convenient to use and can be used in broader applications.

SUMMARY OF THE INVENTION

It is an object of the invention to provide an article holding device for use on clothing that can be applied instantly and be ready for use immediately on an article that is a separate entity from the invention. A further feature of the invention is that it does not require a prefixed article or parts outside of the invention to make the invention operable and that the article is capable of detaching and reattaching to the device.

It is an object of the invention to provide an article holding device for use on clothing that can be effective during physically demanding situations and/or more demanding natural environments such as underwater, but that is also appropriate to wear for more social situations.

It is an object of the invention to provide an article holding device for use on clothing that can be applied to new uses to offer more versatility regarding place of use and ease of use.

It is an object of the invention to provide an article holding device for use on clothing which may also be called a personal carrying device that is the combination of using a fastener with an adhesive back and a removable liner for attachment to an article of suitable kind that can be detached and reattached to a fastener on a securing mechanism base which connects to clothing.

It is an object of the invention to provide an article holding device where a variety of embodiments can be used to hold different kinds of articles in different kinds of environments and where the combination of fasteners with fastening material and adhesive backs that are not necessarily intended for each other work well together.

Another object is to provide an article holding device for use on clothing whereby two strips have pieces of fastening material of a complementary type thereon with the first strip comprising an adhesive back that attaches to the article when a protective liner is peeled off.

Another object is to provide an article holding device for use on clothing that is appropriate to wear at almost any kind of activity or occasion, for example, business functions, weddings, beach parties, marathons, etc., and that won't chafe the wearer's body if the wearer is dressed in lightweight clothing such as running gear.

Another object is to provide an article holding device for single use cameras to be used on clothing where the device can be applied instantly and ready for use immediately thereafter without requiring parts not included in the invention.

A further feature is to provide a device for holding single use cameras that provides the convenience of hands free carrying, quick access, and a secure hold for keeping cameras from getting lost or misplaced, and is appropriate to wear with clothing that is suitable for almost any kind of occasion.

Additional objects and advantages of the invention for single use camera usage are (a) to provide a personal carrying device which is attractive, fashionable, and can be worn appropriately at almost any social occasion;

(b) to provide a personal carrying device which is reliable and where a single use camera will rarely fall off and get lost;

(c) to provide a personal carrying device which is small in size and lightweight:

(d) to provide a personal carrying device which is economical relative to the price of single use cameras;

(e) to provide a personal carrying device which is designed for one time use with single use cameras, but can be reused with replacement or reusable parts;

(f) to provide a personal carrying device which is designed for carrying a single use camera conveniently without discomfort;

(g) to provide a personal carrying device which does not take space away from carrying other items consumers want in their pockets;

(h) to provide a personal carrying device which does not expose dirt to the lens of a single use camera as can occur if carried in pockets of clothing or in ancillary carrying products;

(i) to provide a personal carrying device which does not add wear or tear to clothing;

(j) to provide a personal carrying device which makes single use cameras readily accessible for quick unexpected photo opportunities;

(k) to provide a personal carrying device which is a permanent repository or home location for a single use camera in transport so that chances for misplacement is reduced;

(l) to provide a personal carrying device which does not get in the way of camera operation;

(m) to provide a personal carrying device which does not get in the way of other activities and can be used while swimming or snorkeling;

(n) to provide a personal carrying device which does not restrict hand movement;

(o) to provide a personal carrying device which does not strain part of the human body, especially the wrist or hand;

(p) to provide a personal carrying device which can be compared to other consumer accepted products;

(q) to provide a personal carrying device which can be attached to single use cameras by manufacturers, thereby becoming part of the camera and offered to consumers as added value;

(r) to provide a personal carrying device which can be provided to consumers as a free standing product;

(s) to provide a personal carrying device which emits a sound when a single use camera is detached in order for a consumer to know when it is being released;

(t) to provide a personal carrying device which doesn't require any items beyond everyday clothing for its use;

(u) to provide a personal carrying device which is easy to use;

(v) to provide a personal carrying device which is durable;

(w) to provide a personal carrying device which is easy to produce;

(x) to provide a personal carrying device which is reliable because it is worn and not carried;

(y) to provide a personal carrying device which provides an overall higher quality result than current carrying devices; and (z) to provide a personal carrying device which is stronger and can hold more weight more comfortably than current methods.

Further objects and advantages are to provide a personal carrying device which obviates the need to use a pocket, ancillary bag, hand, or strap to carry a single use camera or other suitable kind of article. Still further objects and advantages will become apparent from a consideration of the ensuing description and drawings.

The reader will see that the device for holding suitable articles on clothing like single use cameras uniquely provides the advantages of being ready to use, self contained and immediately workable once an article is applied to it. Coupled with these advantages, the current invention also distinguishes itself from the prior art because of its ability to be successfully used in extreme situations like under water or during sports. It separates itself even further with its preferred embodiment using industrial fasteners with different combinations of adhesives so that the current invention can be used for a broader range of articles, situations and environments.

Physically, it differs from prior art related to holding devices for articles on clothing because of its fastener with an adhesive back and a removable liner.

Operationally, the current invention significantly differs from the prior art because it requires removing a liner on the fastening strip to expose an adhesive back which is then attached to the article so that the article can be instantly connected to the invention and immediately used without the need for a prefixed article or extraneous adhesives, equipment, or labor.

The current invention is a highly reliable, lightweight, accessible, yet economical device that can be used by persons of almost any age. It permits single use cameras and other small articles to be worn and not carried which makes it easy, convenient, and visually pleasing. Moreover, it does not interfere with operation of the article or camera, restrict normal body movement, take room away from other items that one carries in bags or pockets, or damage clothing. It makes articles like single use cameras easy to find and use. It emits a noise when the attached product is released that warns if the product is about to be lost or taken which also increases one's confidence in the protective nature of the device.

Currently, consumers transport single use cameras mostly in pockets of clothing, in ancillary products such as daypacks, and by hand. They are accustomed to these modes and no products are sold separately to hold single use cameras on one's clothing besides the current invention; thus, any product that can help perform this finction better would fulfill an unrecognized need and provide an advantage which never before was appreciated.

Uniquely, the device for holding articles on clothing allows articles like single use cameras to be removed and replaced in a quick and secure manner, which in the case of single use cameras enables one to capture unexpected photo opportunities. The synergism between the securing mechanism base and adhesive backed fasteners produces a result that exceeds the benefits of their individual attributes and the expectations of users; especially, the secure holding capability for single use cameras which produces surprise results for photographers who use the longer and heavier flash cameras. Furthermore, the detaching capability of the camera from the securing mechanism base provides photographers easier shooting because a permanently attached security mechanism base would rub against their face.

If included with single use cameras at their factories, this invention can increase the value of single use cameras to consumers by manufacturers. In addition, the ready to use feature of the current invention is especially appreciated by runners because they can attach it to the camera themselves immediately before a race and have it operate instantly. For the nonphoto taking runner, this was an unappreciated advantage prior to the current invention's availability. For the photo taking runner, it solves a long felt need.

Most important, a free standing article holding device for clothing can provide consumers their own ability to make many suitable articles portable instantly and without other parts, equipment, or service.

DETAILED DESCRIPTION OF THE INVENTION

Figure 1:
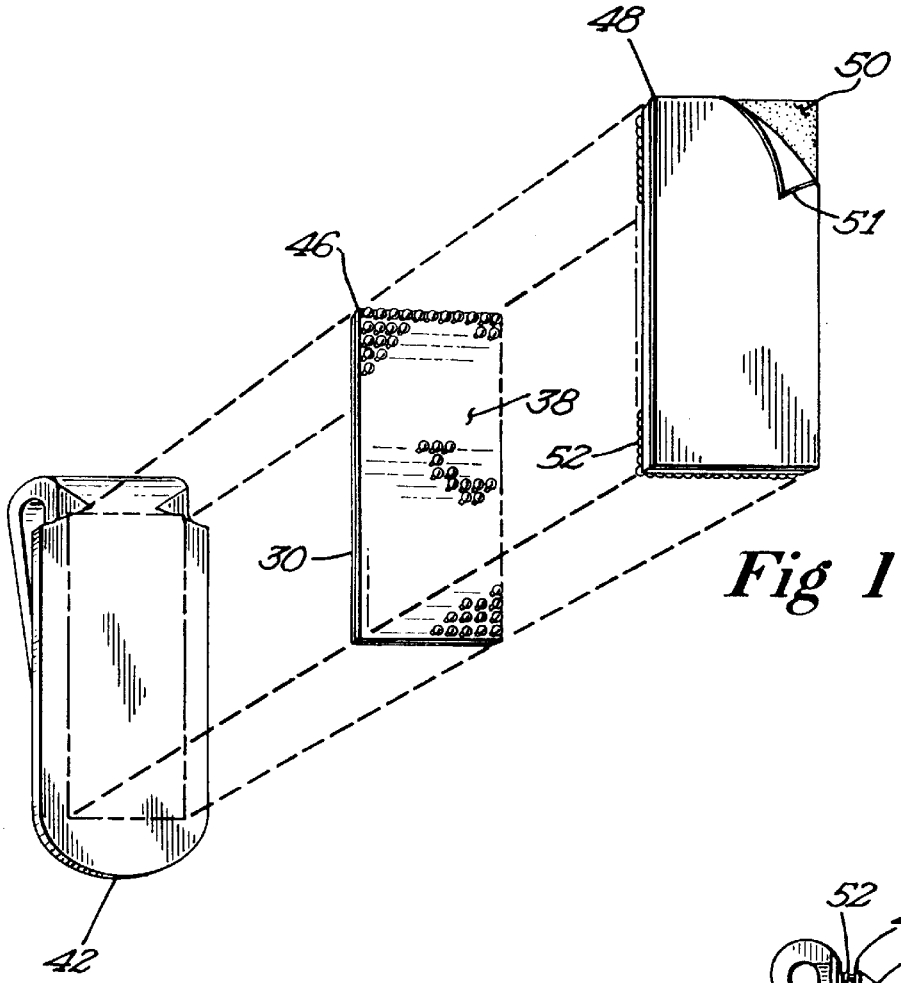
FIG. 1 shows an exploded view of the article holding device for clothing ready to accept an article after a protective liner is partially peeled off.
Figure 3:
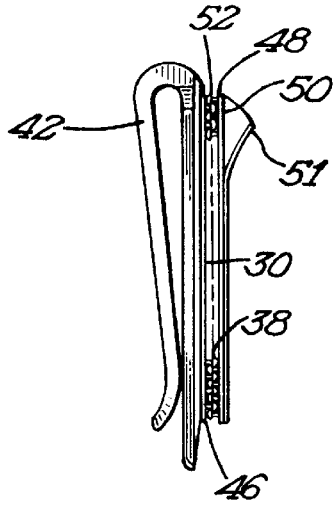
FIG. 3 shows a side view of the article holding device for clothing ready to accept an article after a protective liner is partially peeled off.
Figure 2:
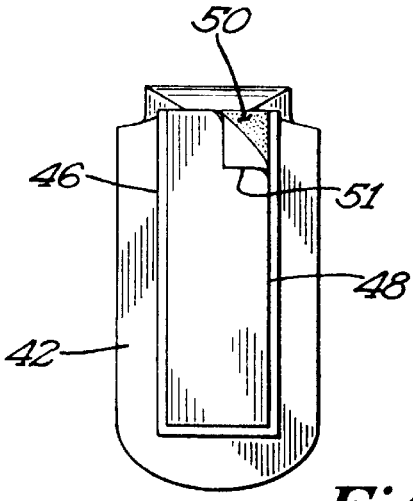
FIG. 2 shows a front view of the article holding device for clothing ready to accept an article after a protective liner is partially peeled off.
Figure 6:
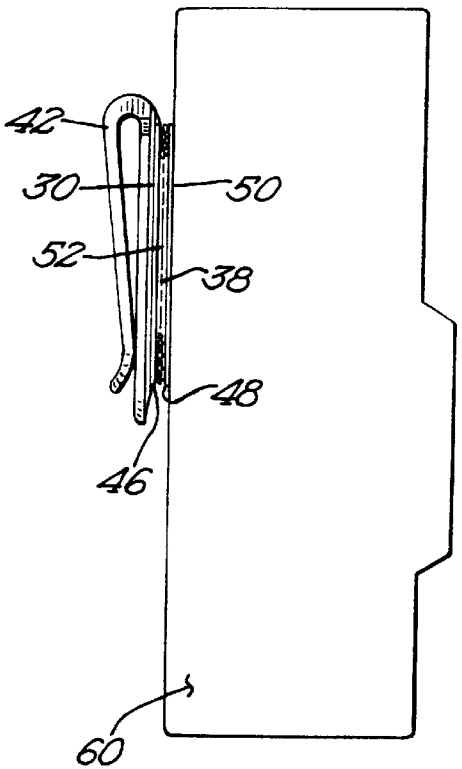
FIG. 6 shows a side view of the article holding device holding a single use camera.
Figure 5:
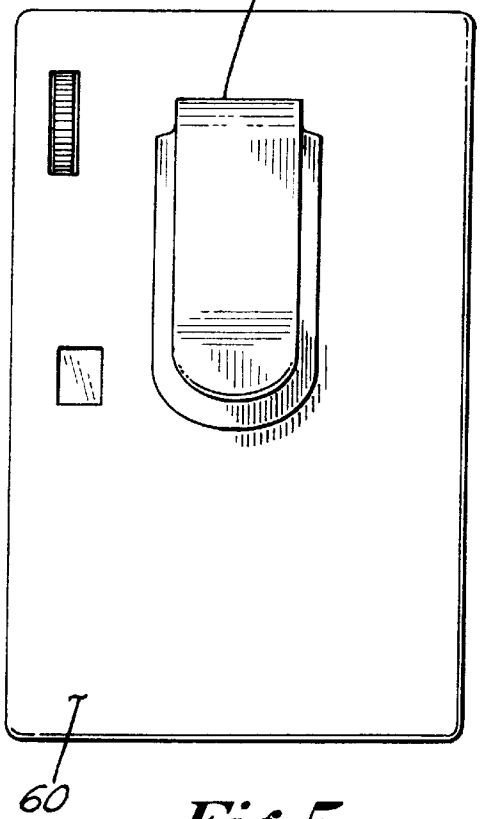
FIG. 5 shows a back view of the article holding device holding a single use camera.
Figure 4:
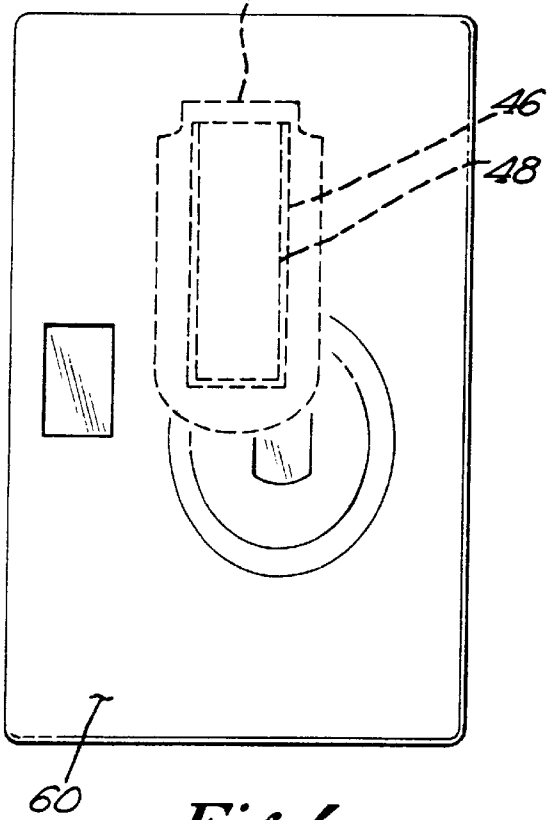
FIG. 4 shows a front view of the article holding device holding a single use camera with hidden lines.

Referring to FIGS. 1–6, the article holding device includes first and second fastening strips 48 and 46 which can be of any suitable material, for example, plastic, fabric, etc. The first fastening strip 48 has on one surface thereof fastening material 52 which also can be of any suitable material, for example, plastic, fabric hook and loop, etc. The fastening material 52 is preferably plastic for underwater use or use in physically demanding situations. FIGS. 1 and 2 show an article holding device comprising, in one kind of embodiment, a securing mechanism base, an industrial fastener of plastic backing with plastic mushroom shaped stems protruding up from the backing strip with an adhesive back such as 3M DUAL LOCK brand Industrial Fasteners with adhesive face down, and a complementary industrial fastener of plastic backing with plastic mushroom shaped stems protruding up from the backing strip with an adhesive back with adhesive and protective liner face up.

In one embodiment of the invention, the fastening strip 48 is an industrial fastener of plastic backing with plastic mushroom shaped stems 52 protruding up from the backing strip with an adhesive back 50 shown in FIG. 2 as stippling and a protective liner 51 such as with 3M DUAL LOCK brand Industrial Fasteners, available from the 3M Company in Saint Paul, Minn.

The 3M DUAL LOCK brand fasteners are reclosable fasteners that can exert a gripping force varying from a fraction of a pound to several hundred pounds depending on the surface area engaged. The fastener is closed by pressing the two substantially identical materials together, and they are separated by peeling them apart. Each plastic strip is covered with a pattern of stems having mushroom shaped heads. The density is typically either 170 or 400 stems per square inch. The two opposed surfaces can lock together in substantially any position. The flexible plastic strips are backed with either a synthetic rubber adhesive or an acrylic adhesive, the plastic strip itself being composed of a polyolefin. The stems have lengths of between 0.05 and 0.15 inch, while the width of the plastic strips is typically between 0.4 and 1.0 inch.

The tensile strength of the attached surfaces is between 16 and 60 pounds force per square inch, while the peel strength is between 8 and 12 pounds force per inch of width of the plastic strip.

When two pieces of DUAL LOCK brand fasteners are pressed together, the mushroom heads interlock with one another making an audible snap; conversely, when they are pulled apart, the fasteners open. The material 52 is shown along the entire area of strip 48. In a preferred embodiment, the adhesive 50 would be of the reusable type in order to avoid the need for additional fasteners for use on more than one article. The orientation of strip 48 is generally vertical with respect to the normal orientation of the article it is holding.

The length of the first strip 48 is selected depending upon the size of the securing mechanism base 42 and the article to be held. In general, it is no longer or wider than the second strip 46. However, first strip 48 can be longer or wider in order to provide more fastening space, thereby making the article easier to attach to the rest of the invention. This is especially important for underwater usage where a wider first strip 48 compensates for the refraction of light that can make it more difficult to establish a proper connection with second strip 46.

First strip 48 is physically different from strips in the prior art related to carrying articles on clothing because of its adhesive back and protective liner. No other prior art mentions or anticipates this although these kind of fasteners have been available for around twenty years.

In addition, no prior art mentions or anticipates using industrial fasteners such as DUAL LOCK brand fasteners as an embodiment so that the article won't fall off when rubbed against as in riding a bicycle or worn underwater, and, specifically, the industrial fastener's different fastening technique of matching mushroom heads.

The second strip 46 has on one surface thereof fastening material 38 which must be fastenable to fastening material 52. Fastening material 38, in this embodiment, is also an industrial fastener of plastic backing with plastic mushroom shaped stems protruding up from the back strip with an adhesive back 30 such as 3M DUAL LOCK brand Industrial Fasteners, but where the protective liner is removed. Depending upon the specific fastener used on first strip 48, the best holding fastener on second strip 46 may have more, less, or the same amount of stems as the fastener on the first strip 48, whichever is designated as the compatible piece by the manufacturer.

The strip 46 is attached to securing mechanism base 42 by the adhesive back 30, although it should be understood that any suitable fastening arrangement can be utilized, such as heat sealing, etc., depending upon the type of material of strip 46 and the securing mechanism base 42.

Industrial fasteners usually have the same kind of adhesive on the backs of their complementary pieces. However, the adhesive required for the securing mechanism base 42 and the article may need to be different in the current invention depending upon the material composition of the securing mechanism base 42 and the article and/or the environment in which they are used together.

Therefore, it is sometimes necessary to select industrial fasteners that are not the intended combination by the manufacturer because they have adhesive backs which will hold better on respective surfaces and still have fasteners that grip each other strongly. One such kind of embodiment is for underwater single use cameras. The material composition of the plastic base and the plastic case around the camera does not respond to the same adhesives similarly underwater. Thus, the underwater single use camera carrying clip has fastening strips on the camera and the securing mechanism base that are made from general purpose pressure sensitive and premium acrylic pressure sensitive materials, respectively, and the adhesive backs are a rubber adhesive and a very high bond, plasticizer resistant adhesive, respectively. It also appears that underwater use of DUAL LOCK brand industrial fasteners is an unintended use for these fasteners because this use is not suggested in the product literature.

In one embodiment of the invention, securing mechanism base 42 is a standard eyeglass clip, but it should be understood that it can be any kind of securing mechanism, for example, a snap, a spring, etc., and made from any material, for example, plastic, metal, etc.

In a preferred embodiment, the securing mechanism base 42 can be enhanced with a fastening edge or tooth at its end or a safety pin, etc., depending upon what situations the device is used in, what is carried, and the price threshold for the device. The types of securing mechanisms, materials, and enhancements generally depend upon the article being held.

From the description above, a number of advantages of my article holding device becomes evident: it is ready to use; works immediately; is self contained; is adaptable to various materials; is strong; is small; is lightweight; is durable; and is easy to produce.

The use of the device is described with reference to FIGS. 1–6. As shown, the article to be held, here illustratively the single use camera 60, is placed adjacent to the adhesive back 50 on the strip 48 which has the protective liner 51 peeled off. Placement of the strip 48 is lengthwise across the back of the single use camera 60 from one side to approximately the middle of the camera, midway between top and bottom of the camera, preferably on an end where the plastic body is exposed. The adhesive back 50 will adhere to the single use camber 60 instantly for immediate use although a 24 hour waiting period is recommended for underwater use. The device is pressed onto the single use camera 60 and attached to clothing, for example, a belt, a pant or skirt waistband, pocket, etc. The article is released for use by separating fastening materials 52 and 38 and restored by linking fasteners 52 and 38 together again making sure the connection is complete. The strip 48 with fastener 52 must be replaced to hold successive articles unless the adhesive is of the reusable kind.

While the device has been shown in FIGS. 1–6 as holding a single use camera 60, it should be understood that other articles can be held on clothing with this device.

Therefore, the purpose of securing mechanism base 42 is to provide a structure for supporting any suitable article like single use camera 60 on clothing. The strip 46 provides the ability for securing mechanism base 42 to hold the single use camera 60 when the strip 48 is joined to the camera.

In addition, strips 46 and 48 permit the quick release and replacement of the single use camera to one's clothing without removing securing mechanism base 42.

Thus, the scope of the invention should be determined not by the embodiments illustrated, but by the appended claims and their legal equivalents.

I claim:

1. Device for removably holding an article to clothing while under water comprising, in combination: means for releasably fastening the article to the clothing while the article is under water, wherein the releasably fastening means comprises first and second flexible fastening strips of material each having first and second sides, with the second side of the first flexible fastening strip of material having fastening material, with the second side of the second flexible fastening strip of material having fastening material which is releasably fastenable with the fastening material of the first flexible fastening strip of material while under water, with the first side of the second flexible fastening strip of material being attachable to the clothing, with the first side of the first flexible fastening strip of material being attachable to the article, thereby permitting quick release and replacement of the article to the clothing while the article is under water.

2. The device of claim 1 further comprising, in combination: a first adhesive for backing the first side of the second fastening strip of material; and a second adhesive for backing the first side of the first fastening strip of material, with the second adhesive being different than the first adhesive.

3. The device of claim 2 wherein the first adhesive is a general purpose pressure sensitive adhesive and the second adhesive is a premium acrylic pressure sensitive adhesive.

4. The device of claim 2 wherein the first adhesive is a rubber adhesive and the second adhesive is a plasticizer resistant adhesive.

5. The device of claim 2 wherein the article comprises an under water single use camera.

6. The device of claim 2 wherein the first and second fastening strips are formed of plastic.

7. The device of claim 6 wherein the first and second fastening strips of material are composed substantially of polyolefin.

8. The device of claim 2 further comprising, in combination: a protective liner for abutting with the second adhesive, with the second adhesive being attachable to the article upon removal of the protective liner.

9. The device of claim 1 further comprising, in combination: a securing mechanism for clipping to the clothing, with the first side of the second flexible fastening strip of material being attached to the securing mechanism thereby permitting quick release and replacement of the article to the securing mechanism without removing the securing mechanism from the clothing.

10. The device of claim 9 wherein the securing mechanism comprises, in combination:

a. a flat portion; and b. a curved portion, the curved portion being formed integrally with the flat portion, the curved portion being biased to opposably contact the flat portion.

11. The device of claim 1 wherein the fastening material of the first and second fastening strips of material comprise a plurality of stems extending substantially perpendicularly from the second side of the fastening strip of material; and wherein each stem farther comprises:

a. a shaft portion; and b. an enlarged head portion, the enlarged head portion being substantially mushroom shaped, wherein the stems are affixed to the second side of the plastic fastening strip of material at a density of approximately four hundred stems per square inch of second side surface area.

12. The device of claim 1 wherein the fastening material of the first and second fastening strips of material comprise fastening material making an audible snap when the fastening material of the first fastening strip of material is released from the fastening material of the second fastening strip of material.

13. The device of claim 1 further comprising, in combination: an under water camera, with the article removably held to the clothing being the under water camera.

14. Method for removably holding an article to clothing while under water comprising the steps of: attaching a first side of a first flexible fastening strip of material to the clothing, with the first flexible fastening strip of material also having a second side including fastening material; attaching a first side of a second flexible fastening strip of material to the article, with the second flexible fastening strip of material also having a second side including fastening material which is releasably fastenable with the fastening material of the first flexible fastening strip of material while under water; pressing the fastening material of the second flexible fastening strip of material while the second flexible fastening strip of material is attached to the article into releasably interlocking engagement with the fastening material of the first flexible fastening strip of material while the first flexible fastening strip of material is attached to the clothing; performing an activity where the first and second flexible fastening strips of material are under water while in interlocking engagement; releasing the second flexible fastening strip of material while the second flexible fastening strip of material is attached to the article from the first flexible fastening strip of material while the first flexible fastening strip of material is attached to the clothing; and replacing the second flexible fastening strip of material while the second flexible fastening strip of material is attached to the article into releasably interlocking engagement with the first flexible fastening strip of material while the first flexible fastening strip of material is attached to the clothing.

15. The method of claim 14 wherein the replacing step comprises the step of replacing the second flexible fastening strip of material while the second flexible fastening strip of material is attached to the article into releasably interlocking engagement with the first flexible fastening strip of material while the first flexible fastening strip of material is attached to the clothing and while the first and second flexible fastening strips of material are under water.

16. The method of claim 14 wherein the step of attaching the first side of the second flexible strip of material comprises the step of attaching the first side of the second flexible strip of material to an under water camera.

17. The method of claim 14 further comprising the step of providing a securing mechanism, with the step of attaching the first side of the first flexible fastening strip of material comprising the steps of: attaching the first side of the first flexible fastening strip of material to the securing mechanism; and clipping the securing mechanism with the attached first flexible fastening strip of material to the clothing.

18. The method of claim 17 wherein the step of attaching the first side of the second flexible fastening strip of material comprises the steps of: providing a first adhesive on the first side of the second flexible fastening strip of material; abutting the first adhesive with a protective liner; and removing the protective liner from the first adhesive for attaching the first adhesive to the article.

19. The method of claim 18 wherein the step of attaching the first side of the first flexible fastening strip of material comprises the step of adhering the first side of the first flexible fastening strip of material to the securing mechanism with a second adhesive different from the first adhesive.

* * * * *